United States Patent [19]

Parise

[11] 4,367,565

[45] Jan. 11, 1983

[54] DOUBLE INSULATED WET/DRY VACUUM EXTRACTION MACHINE

[75] Inventor: Carl Parise, Reno, Nev.

[73] Assignee: Parise & Sons, Inc., Sparks, Nev.

[21] Appl. No.: 263,382

[22] Filed: May 13, 1981

[51] Int. Cl.[3] ..... A47L 9/12; A47L 9/18

[52] U.S. Cl. ..... 15/321; 15/328; 15/353

[58] Field of Search ..... 15/320, 321, 353, 328

[56] References Cited

U.S. PATENT DOCUMENTS

| | | | |
|---|---|---|---|
| 3,940,826 | 3/1976 | Phillips et al. | 15/320 |
| 4,200,951 | 5/1980 | Burgoon et al. | 15/321 |
| 4,287,635 | 9/1981 | Jacobs | 15/328 X |
| 4,287,636 | 9/1981 | Brazier | 15/321 |
| 4,310,945 | 1/1982 | Tribolet | 15/353 X |
| 4,314,385 | 2/1982 | Wimsatt et al. | 15/328 X |

*Primary Examiner*—Chris K. Moore

*Attorney, Agent, or Firm*—Sughrue, Mion, Zinn, Macpeak & Seas

[57] ABSTRACT

An open top, double walled, plastic hot water storage tank is mounted within a two section injected plastic casing and is spaced internally from the walls of the casing to thermally insulate the hot water tank. A removable cylindrical dump tank closely fits the interior of a cylindrical inner wall of the storage tank. A rotatable dome locks to the upper casing half to seal off the top of the dump tank. The dump tank bears a splash deflector and filter assembly when the machine functions as a wet vacuum extraction machine. A cloth filter bag and internally replaceable paper filter bag operate in place of the dump tank when the machine functions as a dry vacuum extraction machine. A water jet circulation bypass loop maintains the water in the hot water tank in circulation. Both the vacuum pump and water are double electrically insulated. A tool caddy clamps to the casing to permit the casing to stand on end for storage of the apparatus when not in use. The tool caddy carries removable tools for selective coupling to a conventional vacuum cleaner wand.

16 Claims, 11 Drawing Figures

DOUBLE INSULATED WET/DRY VACUUM EXTRACTION MACHINE

FIELD OF THE INVENTION

This invention relates to vacuum cleaners, and more particularly to a vacuum cleaner which may be interchangeably employed as a dry vacuum cleaner or as a wet vacuum extraction machine.

BACKGROUND OF THE INVENTION

In 1973, applicant Carl Parise invented a hot water vacuum extraction machine which was capable of functioning in the home to wet clean wall to wall carpeting and the like, and which could be readily handled by a housewife in contrast to "steam cleaners" generally employed by commercial operators. Such machines operate by jetting hot water (or water and cleaner solution) onto the rug, at a point adjacent to a vacuum pick-up head, the vacuum head acting to remove the water and entrained dirt from the rug near the point of water spray application. Dirty water is normally returned, in commercial operations, either to a relatively large cleaner unit within the room bearing the carpet being cleaned or through extended hoses, to a truck mounted apparatus exterior of the building housing the carpeting.

The smaller, lightweight Parise machines for the housewife were an instant success, and such machines were provided for lease purposes to grocery stores, hardware stores, convenience stores and the like.

A number of patents have issued to applicant Carl Parise with respect to hot water vacuum extraction machines. Representative U.S. Pat. Nos. are:

3,896,521 "HOME CLEANING SYSTEM"
3,911,524 "STEAM CLEANER DUMP BUCKET"
4,015,589 "STEAM CLEANER PROTECTION SCREEN"
4,046,989 "HEATER FOR A HOT WATER EXTRACTION UNIT"
4,075,733 "CLEANING HEAD"
4,078,908 "HYDRO AIR FILTER"
4,083,705 "REVERSE FLOW HYDRO AIR FILTER FOR WET/DRY PICK UP SYSTEM"
4,088,462 "HOT WATER EXTRACTION UNIT"
4,122,579 "STEAM CLEANER DUMP BUCKET"

Such "home use" hot water vacuum extraction machines require electrically powered vacuum and water pumps within the casing proper of the machine and remote from the vacuum pick-up head itself, which is normally coupled to the machine via a rigid tubular wand and flexible hose to return the water and entrained dirt to a removable dump tank carried by the machine casing. In some circumstances, it is desirable to employ a power scrubber head bearing a motor which rotates a revolvable brush or the like and adjacent the vacuum extraction nozzle slot. There exists the possibility of electrical short and the possibility of electrical shock to the machine operator from such electrical elements. Carl Parise, within several years of developing his "home use" hot water vacuum extraction machines, realized the necessity to electrically insulate the electrical elements within the vacuum extraction machines from areas of possible contact by the operator such as the return water dump tank.

A double insulated water pump was devised by the applicant and incorporated within the commercial hot water vacuum extraction machines some years ago, utilizing a technique wherein the shaft which extends from the water pump drive motor to the impeller and through a sealed bushing, was electrically insulated by an insulation material sheath, to prevent the conducting of electricity through the shaft itself to the impeller and thence to the water leading to the spray head. Further, due to the efforts of applicant, within the past several years, a commercialy available double insulated vacuum pump was produced by Lamb Electric, a Division of AMETEK Corporation which is also electrically double insuating. It utilizes, in the same manner, an electrical insulation sheath about the shaft extending from the vacuum pump motor to the vacuum pump impeller, functioning to provide the suction necessary to the vacuum head for vacuum extraction of the water and entrained dirt adjacent the area of liquid spray onto the carpet.

For the past several years, the corporate assignee of this application has employed plastic as the material forming the exterior casing of its hot water vacuum extraction machines. Initially, such machines included a hot water storage tank and a separate dirty water dump tank formed of metal and mounted within the electrically insulation material plastic casings. Gradually, such metal components have been replaced by plastic components to further prevent electrical shock to the operator by possible electrical short circuit through the water itself from one of the components such as the water pump.

It is, therefore, a primary object of the present invention to provide an improved double insulated hot water vacuum extraction machine in which the major components including the casing, the hot water storage tank and the dump tank, are all formed of electrical insulative material, and wherein an open top double wall plastic hot water storage tank mounts within an injected plastic casing, is spaced from the walls of the casing itself to thermally insulate the hot water tank, and wherein a plastic removable cylindrical dump tank closely fits the interior of the cylindrical inner wall of the storage tank to form a compact assembly.

It is a further object of the present invention to provide an improved double insulated vacuum extraction machine which may be selectively employed as a dry vacuum cleaner or a wet vacuum extraction machine at the convenience of the operator and in an extremely simple and effective manner.

SUMMARY OF THE INVENTION

The present invention is particularly directed to an electrically double insulated wet/dry vacuum extraction machine. An outer casing of electrical and thermal insulation material, preferably molded plastic, is generally rectangular in plan configuration, formed of longitudinally spaced vertical end walls, laterally spaced vertical sidewalls, a bottom wall and a top wall. A circular opening is provided within the top wall. A double walled water tank formed of electrical and thermal insulation material is mounted within the casing. The water tank comprises integrally, inner and outer vertical walls and a bottom wall. The inner wall is of cylindrical form and centered within the circular opening within the top of the outer casing. A removable cylindrical dump tank is mounted coaxially within the cylindrical inner wall of the water tank. A dome overlies the opening within the outer casing top wall and means are provided for locking of the dome to the casing and in sealed contact with the top of the dump tank. Means are provided for supplying vacuum pressure to the interior of the dump tank and to the interior of the inner wall of the water tank. Elbow means carried by the dome and projecting therethrough permit returning air, water and entrained dirt, during wet vacuum extraction mode, to the dump tank, and air plus entrained dirt to at least one filter bag assembly, when operating under the dry vacuum extraction mode.

Means are provided for mounting said least one filter bag assembly within the interior of the water tank inner wall, upon removal of the drum tank, such that application of vacuum pressure to the dump tank or to the interior of the at least one filter bag assembly, permits machine operation selectively under the wet and dry vacuum extraction modes. The dump tank conventionally is an upwardly open cylindrical container including a flanged rim at the open upper end thereof. A riser tube mounts to the dump tank and extends upwardly from the bottom thereof and is open at its lower end to the bottom of the tank. It rises short of the top of the dump tank. Vacuum pressure applied through an opening within the bottom wall of the casing aligned with the riser tube provides vacuum pressure to the interior of the dump tank. A first seal ring is interposed between the bottom of the dump tank and the bottom wall of the casing surrounding the vacuum application opening. The dome bears a second ring seal mounted to the bottom thereof and contacting the open end of the dump tank such that under vacuum pressure, the dump tank is maintained sealed against the bottom wall of the casing and the dome is maintained sealed against the upper end of the dump tank cylindrical sidewall.

A splash deflector and filter assembly is carried by the riser tube within the dump tank. The splash deflector and filter assembly comprise a downwardly convex plate overlying the upper end of the riser tube. A plurality of struts depend downwardly from the deflector plate and are circumferentially spaced about the rise tube and connect at their lower ends to a baffle ring having an inside diameter on the order of the outside diameter of the riser tube and slidably engaging the rise tube. A filter screen surrounds the struts and is interposed between the baffle ring and the deflector plate. Means are provided for maintaining the deflector plate spaced axially at its center from the upper end of the riser tube. The elbow projects through the dome coaxial with the deflector plate, and faces the deflector plate whereby return liquid and entrained dirt enters the interior of the dump tank with the liquid is deflected by the deflector plate towards the cylindrical sidewall of the dump tank to prevent liquid intake into the riser tube. The baffle ring prevents foam from moving upwardly and into the interior of the riser tube upon vacuum pressure application. The screen filters debris and dirt from the return air escaping outwardly of the dump tank through the riser tube.

The casing top wall is provided with a recess defined partially by laterally opposed short vertical wall portions spaced from the circular opening at diametrically opposite positions bearing elongated slots within the short vertical wall portions. The dome comprises an inverted cup-shaped member including a cylindrical sidewall which opens downwardly and bears an outwardly directed radial flange. Flats are formed within the radial flange at diametrically opposite positions over a given radial extent and the radial flange bears axial cams extending circumferentially between the flats such that the flanges upon rotation of the dome enter the slots within the short vertical wall portions of the casing to frictionally lock the dome to the casing and compress the first and second ring seals.

The at least one filter bag assembly may comprise a downwardly concave filter bag support plate having a diameter on the order of the inner sidewall of the water supply tank and spanning across the top of the tank and having at its periphery a rim overlying the upper end of the water supply tank inner sidewall. The filter bag support plate is open at its center and receives the projecting end of the elbow coupled to the dome and projecting therethrough. Laterally spaced parallel tracks carried on the bottom of the filter bag support plate form slots between the tracks and the plate. A filter bag mounting sheet slidably and frictionally engages the slots. The sheet includes an opening within the center further receiving the projecting elbow. A rubber seal sheet is fixedly mounted to the face of a bag support sheet and has an opening within its center of a diameter less than that of the projecting elbow to seal at the outer periphery of the elbow. A primary filter bag is mounted to the filter bag mounting sheet, depends therefrom and is positioned within the cylindrical inner sidewall of the water supply tank. Seal means are interposed between the periphery of the rim of the filter bag support plate and the end of the water tank inner cylindrical sidewall. Upon application of vacuum pressure to the interior of the cylindrical sidewall of the water supply tank, debris returning with the air through the elbow is separated from the air and retained by the primary filter bag. The seal interposed between the rim of the filter support plate and the water supply tank inner sidewall comprises a rubber ring seal and a cloth filter bag is mounted to the ring and is interposed about the primary filter bag and functions as a secondary filter. Preferably, the primary filter bag is a paper filter bag.

The outer casing preferably comprises upper and lower casing sections formed of molded plastic with the sections terminating in outwardly directed flanges which abut each other. At least one the flanges is generally L-shaped in configuration and an elastic rubber bumper of C-shaped cross-section resiliently engages the flanges to clamp and seal the abutting flanges of the casing sections together. The bumper also functions to absorb impact of the machine with objects to eliminate damage to furniture and the like during machine use.

The casing sidewall includes a plurality of inlet slots on opposite sides for cooling air entry and exit. The cooling air is confined within a path defined by a vertical barrier wall of C-shaped cross-section rising the height of the lower casing and surrounding the lower casing inlet slots. A shroud carried by the upper casing section defines a confined air flow path with that of the barrier wall for the cooling air emanating from the inlet slots within the casing sidewall and leading to cooling air inlet openings within the motor casing end wall to prevent moisture from entering the motor for the vacuum pump.

A water pump comprising a motor section and an impeller section is mounted to the interior of the casing. A water pump inlet hose extends from the water supply tank and opens to the interior of the tank and is coupled to the water pump impeller section. A pump discharge water hose mounted at one end to the pump impeller section is mounted at its opposite ends to a water hose coupling which projects through the casing end wall. A recirculation hose coupled to the discharge side of the impeller section, at one end, extends to the water supply tank and is coupled to a fitting which projects through the outer sidewall of the water supply tank. The fitting terminate in a jet nozzle such that a limited volume of water is jetted into the water supply tank after recirculation between the tank and the pump for preventing vapor lock within the water pump discharge hose.

A tool caddy formed of a generally planar base member is molded of plastic and includes integrally a pair of wings at opposite ends projecting to one side thereof along with a central projection to form a three point stand. The base is detachably clamped to an end of the vacuum extraction machine casing such that the machine may up-ended and rested on the wings and projection. Tools are detachably mounted to the base between the wings.

DESCRIPTION OF THE PREFERRED EMBODIMENT

Figure 1:
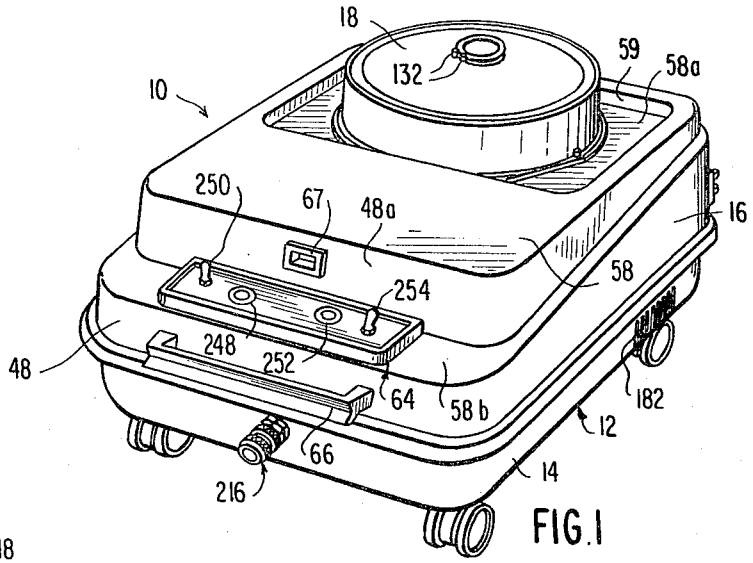
FIG. 1 is a perspective view of a preferred embodiment of the improved double insulated wet/dry vacuum extraction machine of the present invention.

Referring to the drawings, the improved double insulated wet/dry vacuum extraction machine or apparatus forming one embodiment of the present invention. It is indicated generally at 10 and is comprised of a number of main components or elements. These include casing 12 formed by injection molded plastic, as are the majority of the components of the machine. The casing 12 consists of a lower casing section 14 and an upper casing section 16. Further, the upper casing section 14 bears a removable lockable dome 18. The two main electrical components are a vacuum pump indicated generally at 20 and a water pump indicated generally 22. An electrical cord storage reel assembly 24 is mounted within casing 12 to the side of a hot water storage tank, indicated generally at 26, within which, mounts a removable dump tank indicated generally at 28. The dump tank 28, when employed in a wet vacuum extraction mode, bears a splash deflector and filter assembly indicated generally at 30.

Figure 2:
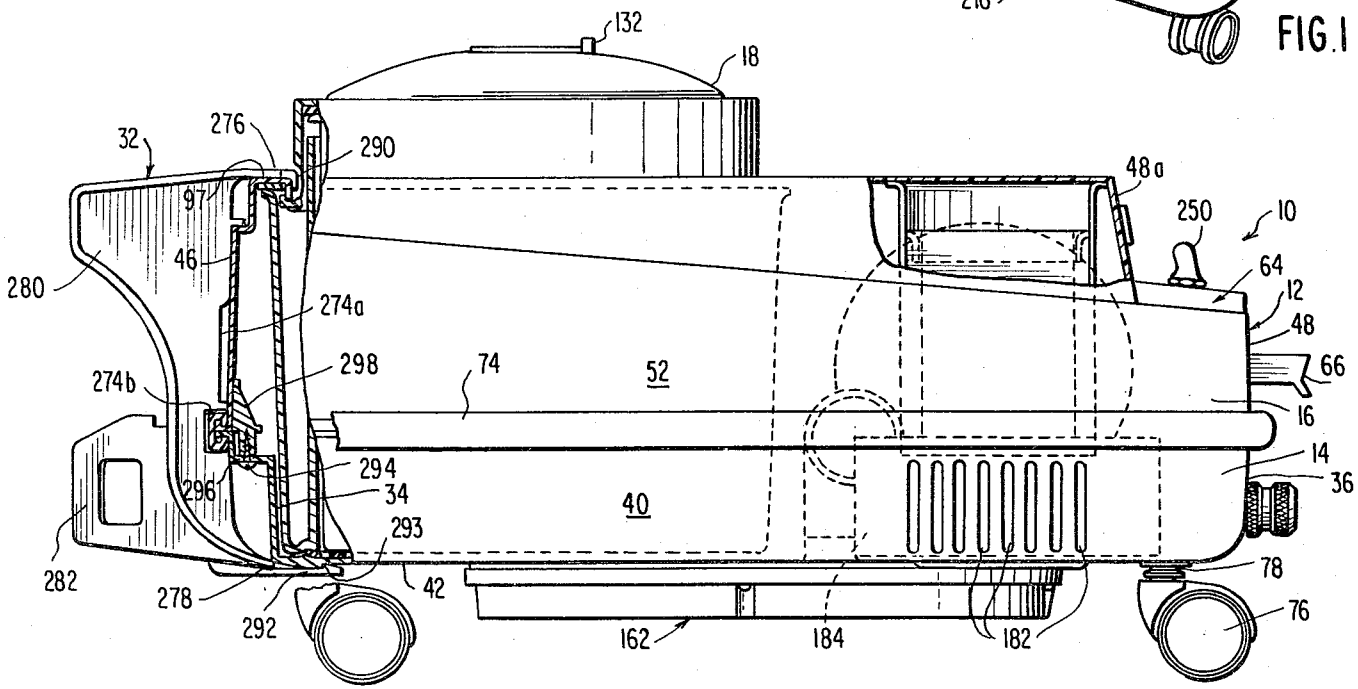
FIG. 2 is a side elevational view of the machine, partially broken away, with a removable tool caddy coupled thereto.
Figure 3:
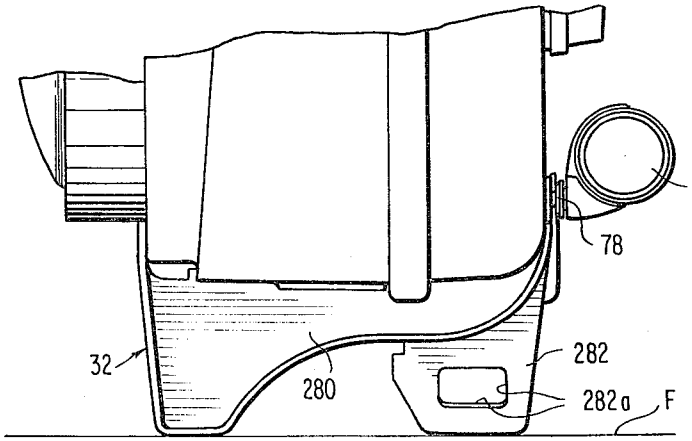
FIG. 3 is a vertical elevational view of a portion of the machine of FIG. 2 with the caddy in place and employed as a stand permitting storage of the machine on end.
Figure 8:
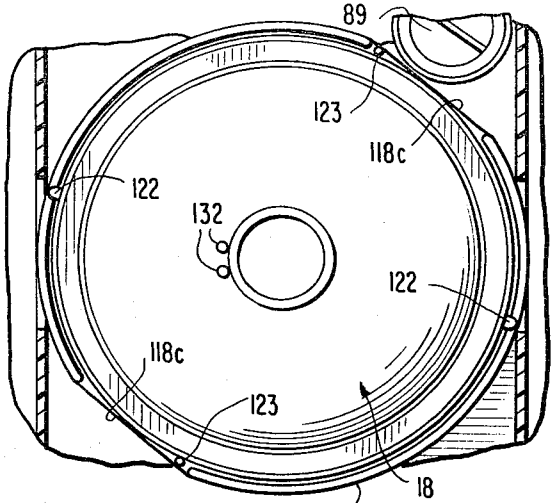
FIG. 8 is a top plan view of a portion of the machine shown in FIG. 1 illustrating the rotatable dome in locked position.

As may be best seen in FIGS. 2, 3 and 8, there is provided to the machine a removable tool caddy 32 which removably supports a number of tools which may be coupled to a vacuum wand (not shown), the tools being conventional. In addition, the tool caddy functions as a stand for standing the machine vertically on end, FIG. 3, when not in use.

One of the principal objects of the present invention is to provide an improved double insulating hot water vacuum extraction machine. Additionally, the machine may be readily converted to a dry vacuum mode and mounting a paper filter bag capable of receiving and holding debris or dirt extracted by the vacuum operation, as received from a vacuum wand and vacuum pick-up head of a conventional nature (neither shown). In that respect, the instant invention employs the two part molded plastic casing 12, with the lower section 14 being upwardly open, being of elongated rectangular plan configuration and including spaced vertical end walls 34, 36, FIG. 2, laterally opposed sidewalls 38 and 40, FIG. 6, and a bottom wall 42. The end and sidewalls extend upwardly and are flanged at their tops. A circumferential flange 44 extends about the periphery of the lower casing section 14. Complementing the lower casing section 14, is the upper casing section 16, more irregularly configured but generally matching that of the lower section 16. It includes longitudinally spaced end walls 46, 48, FIG. 2, laterally opposed sidewalls 50 and 52, FIG. 6, and a top wall 58. The top wall 58 includes a recessed wall portion **58*a*, defined partially by a short height vertical wall portion 59. Recessed portion 58*a* bears a circular opening 60 defined by flange 62. Further, the top wall 58 of the upper casing section 16 is provided with a shelf 58*b* at the front end of the machine, FIG. 1, which mounts a control panel indicated generally at 64. Additionally, a U-shaped handle 66 projects from front end wall 48, permitting the machine to be picked up at that end for up ended storage in the manner of FIG. 3, by use of the tool caddy 32. The shelf 58*b* forms an offset end wall portion 48*a* upon which mounts a rectangular window frame 67 within which is mounted a female electrical plug or receptacle (not shown). The electrical cord 68 is borne by a retractable reel 70, internally of casing 12 and forming one component of retractable reel assembly 24**.

In like manner to the lower casing section 14, the upper casing section 16 is provided with an integral flange 72 which extends fully about its periphery, the flange 72 in this case is T-shaped, terminating in a right angle edge **72*a*. A generally C-shaped bumper 74 formed of rubber or like elastic material engages the casing section flanges 44 and 72, when the casing sections are placed one upon the other to maintain the sections sealably coupled. This permits separation by the act of removing the stretchable elastic bumper 74. The machine itself is a wheeled machine, that is, it may be readily moved across the surface of the floor, rug or the like, utilizing four casters indicated generally at 76, which swivel about a vertical axis as defined by their pintles 78. The pintles 78 mount to the bottom wall 42 of the lower casing section 14, at the four corners thereof. The casters are somewhat larger than those previously employed to insure that an air exhaust port 80 formed within the lower casing section bottom wall 42** is well above the surface of the floor so as to prevent any entry of surface water into the interior of the machine.

As mentioned previously, one of the aspects of the present machine is to provide excellent thermal insulation for a captured, heated, volume of water or water/-cleaner solution for supply to the surface being cleaned via a water spray nozzle (not shown) mounted to a vacuum extraction pick-up head (not shown) normally employed with such machines. In that respect, the hot water storage or supply tank 26 which may be formed by vacuum molding of plastic material, is mounted to the interior of the lower casing section 14 adjacent the rear of that casing section as per FIG. 4. The hot water storage or supply tank 26 is nearly square in plan configuration and is formed with a vertical outer wall 82, a unitary bottom wall 84 and a unitary cylindrical inner wall 86. The walls 82, 84 and 86 define an upwardly open water storage area 88. Further, it is noted that the rectangular outer vertical wall 82 is spaced from opposed sidewalls 38 and 40 of the lower casing section 14 and similarly from the sidewalls 50 and 52 of the upper casing section 1, FIG. 6. Further, the outer wall 82 of the water storage tank is spaced from end wall 34 of the lower casing section 14 and from end wall 46 of the upper casing section 16. Thus, the casing 12 and the outer wall 82 of the hot water storage or supply tank 40 tend to form an air space as an effective thermal insulation means therebetween. While this is somewhat akin to a thermos bottle, it should be noted that there is some air circulation within this space and about the hot water storage tank 26. However, the effect is to maintain the temperature of the hot water W maintained within the area 88 of the water storage tank 26 and extracted from that storage area by operation of the water pump 22 during wet vacuum extraction mode. Water W is supplied to area 88 by removal of a plug 89 with wall 58 at recess 58*a*, FIG. 8.

As may be appreciated, the double walled water storage tank 26 is sealed by way of an annular rubber ring seal 92 to the bottom wall 42 of casing 12.

The hot water storage or supply tank 26 is removably mounted to the bottom or lower section 14 of the casing 12. In that respect, the bottom wall 42 of the casing 12 is provided with an upwardly directed annular projection 90, and the wall has affixed thereto a ring seal 92 having a portion which rides over and onto the projection 90. Further, the bottom wall 84 of tank 26 is provided with an annular indentation or groove 94 which corresponds to the projection 90 and which mates therewith so as to locate the tank 26 within the lower section 14 of casing 12. Further, the upper casing section 16 is provided with a seal strip 96 which surrounds the recess 58*a*, is fixed to the bottom surface of casing section 16 and within the underside of ledge 97 about recess 59*a*. It abuts a flanged end 82*a* of the vertical outer wall 82 of water storage tank 26. When the bumper 74 locks the casing section flanges 72 and 44 together, the upper casing section 16 presses onto the outer vertical wall 82 of tank 26, also pressing the bottom wall 84 of the tank 26 against bottom wall 42 of the lower casing section 14, with sealing between these members provided by seals 92 and 96.

Under operation, either during wet vacuum extraction or dry vacuum extraction modes, the interior of inner wall 86 is subjected to vacuum pressure by way of vacuum pump 20. Dump tank 28 itself is quite similar to the dump tanks of the patents referred to previously, and in that respect the dump tank 28 comprises an upwardly open cylindrical plastic container including a cylindrical sidewall 98, and an integral bottom wall 100, the center of which is open at 102 with the opening defined by a cylindrical collar 104. Mounted within the collar 104 is a central plastic riser tube 106 which may be sealably fixed to the collar 104 within an annular recess 108 as by cementing or thermowelding. Both the tank 28 and the riser tube 106 are formed of plastic material as are the major components of this machine. The upper end of the cylindrical sidewall 98 terminates in a curved flange portion or lip 98*a*, against which rests a rubber ring seal 110 which is fixed to the underside of the removable dome 18. Further, a ring seal 112 is fixed to the bottom wall 42 of the lower casing section 14 as by way of a suitable adhesive, against which the bottom wall 100 of the dump tank 28 rests, outwardly of opening 102. Upon vacuum application to the riser tube 106, the dump tank is sealed to the bottom wall 42 of the casing section 14 by way of ring seal 112. Further, by the same vacuum application to the interior 114 of the dump tank 28, the dome 18 is pulled downwardly with the rubber ring seal 110 compressed between the plastic dome 18 and the flange 98*a* of the dump tank 28.

Figure 9:
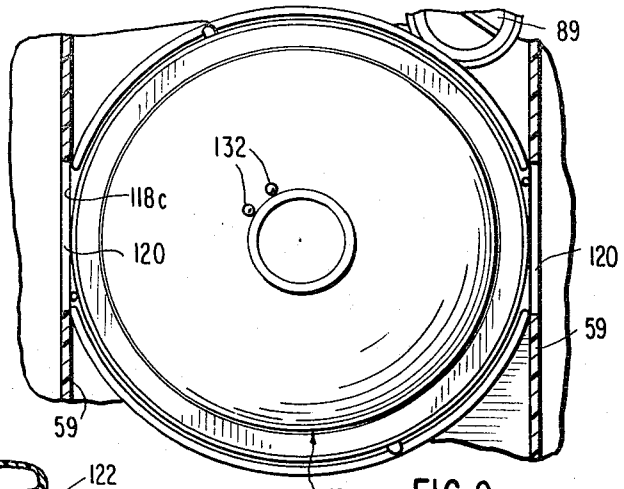
FIG. 9 is a similar top plan view to that of FIG. 8 showing the dome rotated to unlock position.
Figure 10:
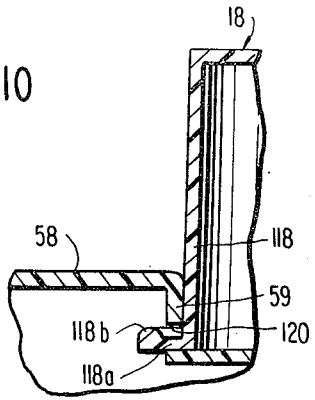
FIG. 10 is a vertical sectional view of a portion of the machine illustrating the nature in which the dome locks to the upper casing section.

The dome 18 is essentially an inverted cup-shaped member including a spherical central wall 116 and a vertical cylindrical sidewall 118. The sidewall 118 terminates in a right angle integral flange portion 118*a*, the flange itself being directed radially outwardly at right angles to the axis of the dome. Portions of the flange 118*a* are provided with paired integral axial locking projections or cams 118*b*. The upwardly directed cams as at 118*b* function as locking members to lock the dome 18 onto the upper casing section 16 and particularly within the rectangular recess 58*a* of that casing section. In that respect, the casing section opposed vertical walls 59, partially defining recess 58*a* at the front and rear of the recess 59*a*, include opposed elongated locking slots 120, FIG. 10. The slots 120 receive the flange portions 118*a* of the dome 18, and the upwardly projecting cams 118*b* tend to move behind the walls 59 and to cam lock dome to the upper casing section 16, as may be appreciated in reverse sequence, FIGS. 8 and 9. FIG. 8 shows the dome 18 locked to the upper casing section 16. FIG. 9 shows the release position, wherein the dome 18 may be vertically lifted. In that respect, there are two flats 118*c* provided to the flange 118 at diametrically opposite positions on the dome 18. Further, the flats are void of the cams 118*b* which are diametrically opposite each other and extend approximately 150° over the periphery of the dome 18 for each cam. As may be appreciated, by rotating the dome 18 approximately 45°, the dome 18 may be securely locked in position with the cams 118*b* camming the dome 18 into a tight frictional fit at locking slots 120, with the upper casing section 16.

Further, the dome 18 is provided with a pair of projections 122 which extend radially outward from the vertical cylindrical sidewall 118 of that member and impact against the outside of the vertical sidewalls 59 of the upper casing section 16 during rotation, to prevent further rotation of the dome 18 once the cams 118*b*, within locking slot 120, are cammed behind the vertical walls 59*a* of the casing section 16. This prevents overrotation of the dome 18 and insures maintenance of the dome 18 under locked conditions, FIG. 8. Vertically upright pins 123 on flange 118 limit dome reverse rotation to release position only.

Figure 6:
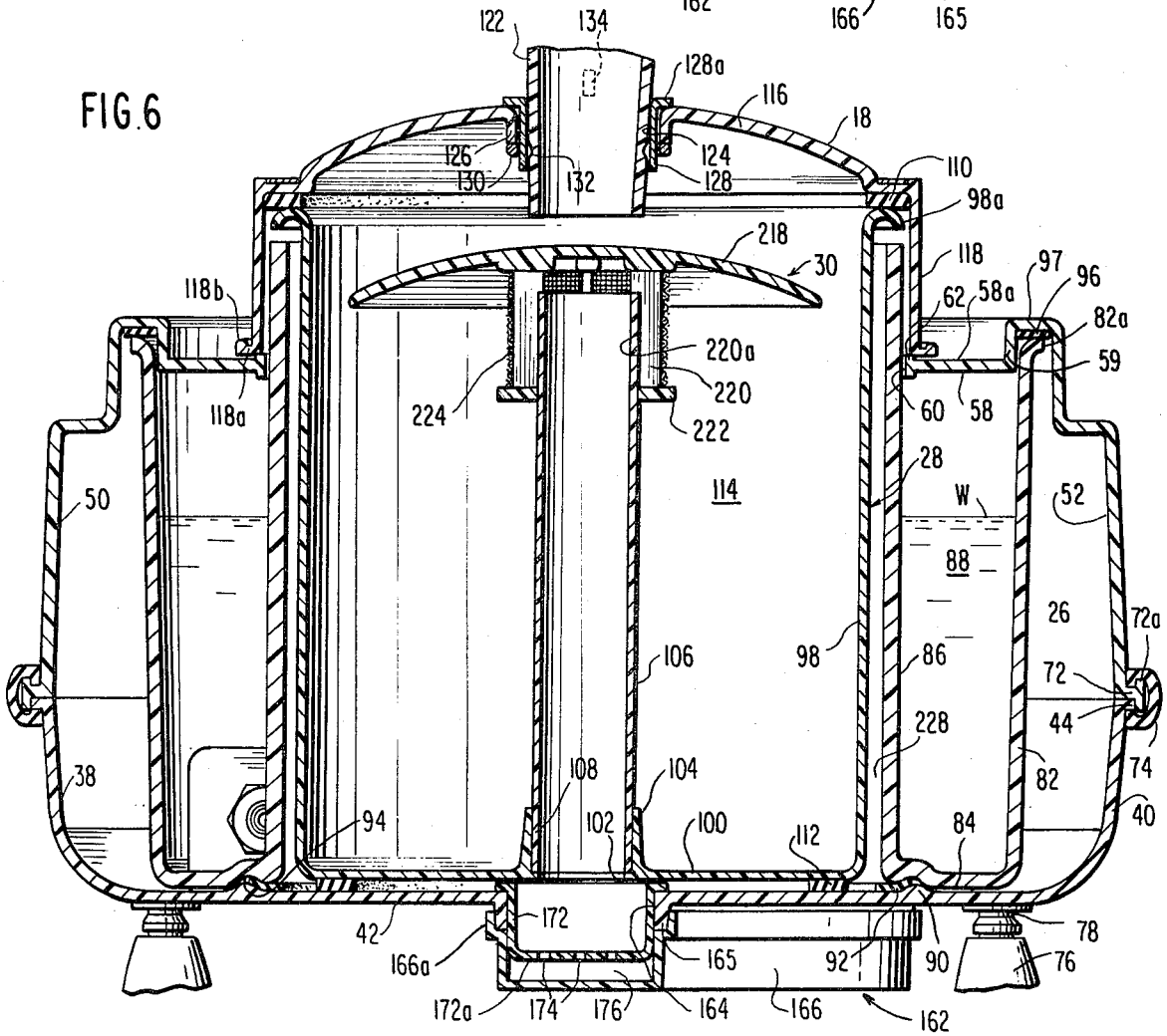
FIG. 6 is a vertical sectional view of the machine shown in FIG. 4, taken about line 6—6, under wet vacuum extraction mode.

As may be appreciated by reference to FIG. 6, with the dome 18 locked to the upper casing section 16, the rubber ring seal 110 is slightly compressed against the flange 98*a* of the dump bucket 28 and, in turn, the ring seal 112 is under slight compression. This effectively maintains the interior of the dump bucket 114 at vacuum pressure when vacuum is applied via hole 102 and riser tube 106 of the dump tank 28 to the interior of the tank 114.

In conformance with the prior art, as evidenced by applicant's earlier patents, water and entrained dirt are returned to the dump tank 28 by way of a vacuum pick-up head (now shown) coupled to the lower end of a tubular wand (not shown) which wand is held in the hand of the operator and swept across the surface of the carpet with the inlet opening of the pick-up head contacting the surface being cleaned such as the upstanding rug fibers. The opposite end of the wand is coupled by way of a flexible corrugated hose (not shown) to on end of an elbow 122 which opens to the interior of the dump tank 28. In the instant case, elbow 122 projects through the center of the dome 18. Only a portion of the elbow is illustrated in FIG. 6. The spherical wall 116 of dome 18 bears a central opening 124 defined by an integral flange or collar 126. A flanged coupling ring 128, which includes a radial flange portion 128*a*, projects within opening 124 and is sized slightly smaller than integral collar 126. The coupling ring 128 bears a bent wire coupling spring 130 which, at selected areas, projects through circumferentially spaced slots within the mounting ring 128 so that portions of the wire ride within a circular groove 132 formed within the wall of the elbow 122, to resiliently lock the elbow 122 in place. Elbow 122 may be permitted to rotate about a vertical axis almost through a full 360°, or may be restricted against rotation. It is restrained from being pulled outwardly of mounting ring 128 by the spring 130. This allows the operator to pull the machine along on its caster wheels 76, while normally allowing the operator to rotate the hose about the axis of elbow 122 with the connection permitting a swivel joint between the elbow 122 and dome 18.

It should be remembered that it is not always desirable to have near 360° swiveling of the hose coupling or connection by way of elbow 122 to the dump tank 28 and through the dome 18. If the pick-up head incorporates an electrically powered brush, in addition to the wand for returning water and entrained dirt, one would employ an electrical cord as well as a hose bearing the water or solution to a spray nozzle attached to the power head. It would not be desirable for the assembly to swivel due to the problems with the electrical cord connections and the like between the casing 12 and the power head. In that case, it is necessary to employ two pins indicated at 132, FIG. 1, projecting upwardly from the dome semi-spherical wall 116 which cooperates with a pin or projection 134, projecting radially outwardly of the elbow 122, FIG. 6, where the elbow projects from mounting ring 128. Projection 134, in occupying a position between the circumferentially spaced pins 132, FIG. 9, prevents rotation of the snap coupling elbow 122.

Figure 4:
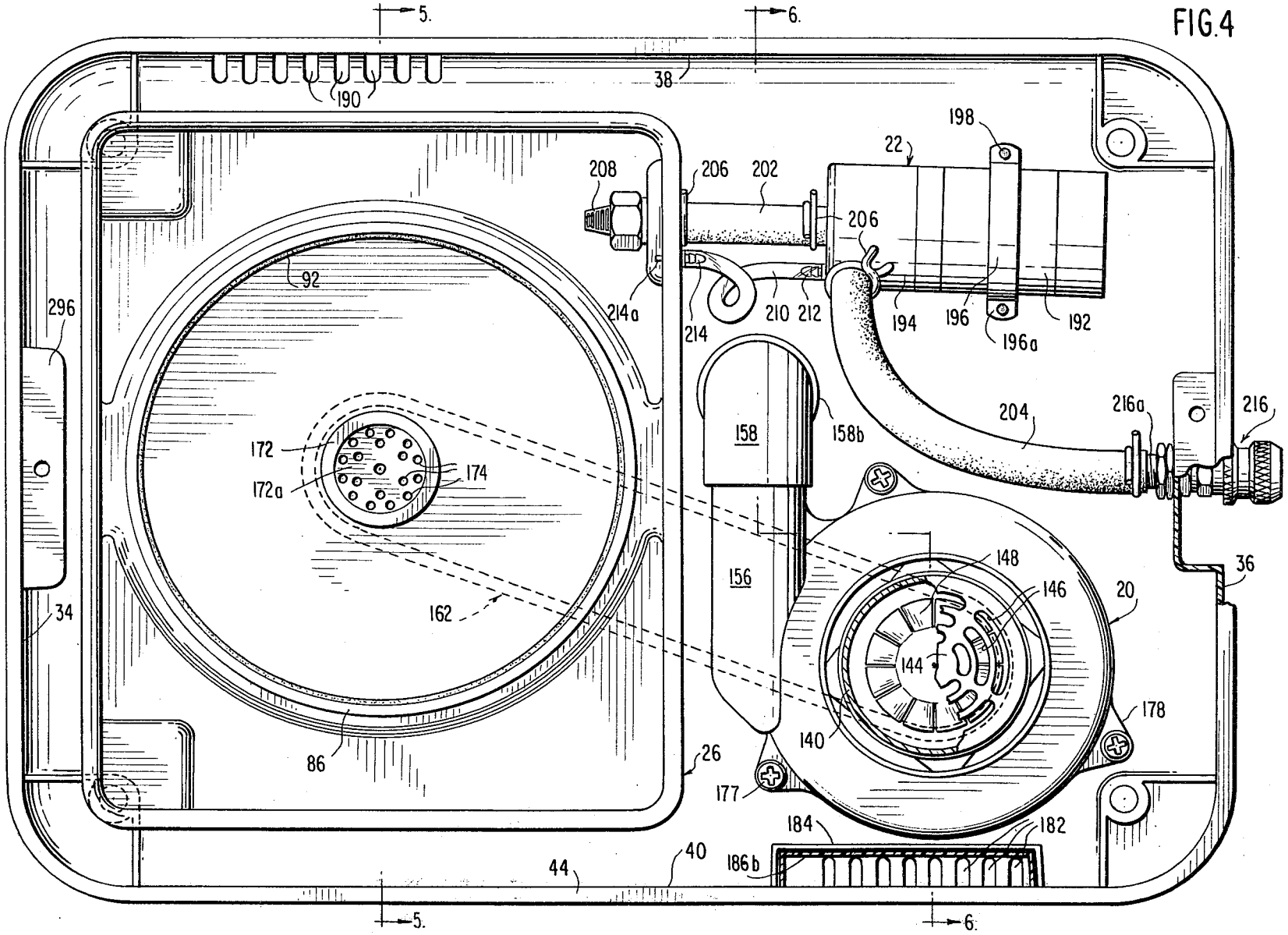
FIG. 4 is a top plan view of the machine of FIG. 1, with the upper casing half removed.

Vacuum pressure is applied to the interior 114 of the dump tank 28 by operation of a vacuum pump 20 which is physically housed at the opposite end of the casing 12, specifically near the front of the machine and laterally of the center line, FIG. 4. As may be appreciated, the vacuum pump 20 constitutes a double insulated assembly and is comprised of two parts: a lower large diameter blower impeller section indicated generally at 136 and an overlying vacuum pump motor indicated generally at 138. The motor 138 includes a cylindrical housing 140 bearing a plurality of cooling discharge slots or air openings 142 within the lower portion thereof, while the casing includes a cover or horizontal wall portion 144, at the top, bearing a plurality of circumferentially spaced annular inlet air slots as at 146 through which cooling air for the motor windings enters. The motor is comprised of a conventional stator and rotor (not shown), the rotor bears a rotor drive shaft (not shown) which extends nearly the length of the casing 140 for the motor itself as well as the larger dimeter blower casing 137. Mounted to the upper end of the shaft (not shown) is a cooling air fan 148 functioning to suck cooling air into the motor casing 140 through openings 146, the cooling air escaping from the motor via the circumferentially spaced slots or openings 142 at a point overlying the blower casing 137. The blower casing 137 is closed off. The casing bears internally, coupled to the lower end of the motor shaft, a blower fan 150 which functions to induce a vacuum pressure at an inlet opening 152 within the bottom wall 154 of the blower housing 137 during operation of the motor 138. In turn, air under positive air pressure exits from the blower through an exhaust pipe 156 leading into an exhaust pipe elbow 158 which is sealably fixed to an integral cylindrical or tubular projection 160 of the lower casing bottom wall 42 which defines exhaust port 80 for the vacuum pump 20.

Vacuum pressure is communicated to the riser pipe 106 by way of an elongated channel track, indicated generally at 162. The casing bottom wall 42 is provided with an elongated slot 164 defined by a depending continuous loop wall 165. Sealably fitted to wall 165 is a cover 166 of U-shaped cross-section being flanged at 166*a*. Extending diagonally across the bottom wall 42 of the lower casing 14, the channel track 162, constituted by a U-shaped cover 166, functions as a vacuum manifold, opening at its one end via circular hole 168 to the riser pipe 106, and at its other end to suction or inlet port 152, via circular hole 167. The channel track, being flanged at 166*a*, sealably fits and may be thermally welded or otherwise adhesively fixed to the wall 165. At the end of the channel track underlying the dump tank 28, the circular opening 168 is provided within the casing bottom wall 42. A flanged cylindrical lint filter cup 172 is snap fitted into the circular opening 168, the cup 172 bearing perforations within its bottom wall 172*a* as at 174 such that any material not captured by the splash deflector and filter assembly 30 is retained by the filter cup 172. With the dump tank 28 removed after rotation and removal of dome 18, the filter cup 172 may be easily lifted from the circular opening 168 for cleaning purposes. The interior 176 of the channel track 162 forms a transverse manifold passage leading from the blower inlet opening 152 to the riser tube 106 of the dump tank, the application of suction pressure via the channel track maintains a seal for the dump tank at ring seal 112 as well as ring seal 110 between the upper flanged edge 98*a* of the dump tank and dome 18.

It should be appreciated that the vacuum pump 20 motor housing 140 and the housing 137 for blower impeller section 136 are preferably plastic or other electrical insulating material, but may be formed of metal. Since they are carried internally of the plastic casing 12 and access to the interior of the same is extremely limited, there is no possibility of electrical shock since there is no contact therewith by the machine operator. As may be further appreciated, the electrical power to this motor internally of the machine is by way of electrically insulated wires which, is conventional and insures the double insulating aspects of machine 10.

Mounting of the vacuum pump 20 to the lower casing section 14 is achieved by way of three screws 177 which project through ears 178 positioned at circumferentially spaced positions about the blower housing 137, the screws 176 being threaded to integral posts 180 as cast uprights within lower casing section 14 and integral with the bottom wall 42 of that member.

In order to further prevent the possibility of electrical shock to the operator should the operator attempt to insert a metallic conducting member through holes within the casing 12 providing for the entry of cooling air for the vacuum pump motor 138, an arrangement is made to provide a baffle in the area of air entry. Cooling air enters the lower casing by means of a plurality of cooling air intake slots 182 within the lower casing section sidewall 40. An integral vertical barrier wall 184, C-shaped in cross-section, rises the height of the lower casing section 14, FIG. 5, and in tha figure, cooling ar indicated by arrows A enters the cooling air slots 182, and passes upwardly between sidewall 40 and the vertically barrier wall 184. Any attempt to penetrate the interior of the casing by a screw driver or the like projecting through a slot 182 is frustrated by the presence of the vertical barrier wall 184 so that a conductive tool cannot contact the casing 137 of the vacuum pump 20.

As may be appreciated, it is important to prevent any water, should it escape the water storage tank 26 and actually penetrate between the double walled tank and the lower casing section 14, from passing into the interior of the vacuum pump motor 138 with the cooling air stream. In that respect, the C-shaped vertical barrier wall 184 integrally cast with the lower casing section 14 rises vertically to surround the area of the sidewall 40 bearing the air intake slots 182. Further, a shroud 186, being of generally inverted L-shape in vertical section and being C-shaped in transverse cross-section, includes a portion 186*a* which terminates at its lower end in an inclined lip 186*b* which fits into the opening defined by the C-shaped barrier wall 184 at its top, and the casing sidewall 40. Thus the air in moving upwardly is confined to a flow path formed by the shroud to enter the vacuum pump motor casing 140 only by way of the arcuate slots 146 within motor casing end wall 144. Further, the shroud is completed by way of a shroud vertical sidewall portion 186*c* which defines a circular opening 188 within the shroud 186 receiving the upper end of motor casing 140 to insure that most of the air entering the casing cooling air inlet slots 182 passes to motor casing 140, initially cut off from the interior of casing 12. The cooling air exits as indicated by arrows A', FIG. 5, outwardly of the vacuum pump motor casing 140 into the space surrounding that motor as defined by the lower and upper casing sections 14 and 16.

In travelling upwardly to the top of the vacuum motor casing 144 by way of a passage formed by shroud 186, not only is the air confined to a path from slots 182 into the interior of the motor casing 144, but upon exiting via circumferentially spaced slots 142 at the bottom of the motor casing 140, the cooling air seeks exit or outlet slots 190 formed within the opposite sidewall 38 of the lower casing section 14 near the rear end of the machine and to the side of water storage tank 26, FIG. 4.

Figure 5:
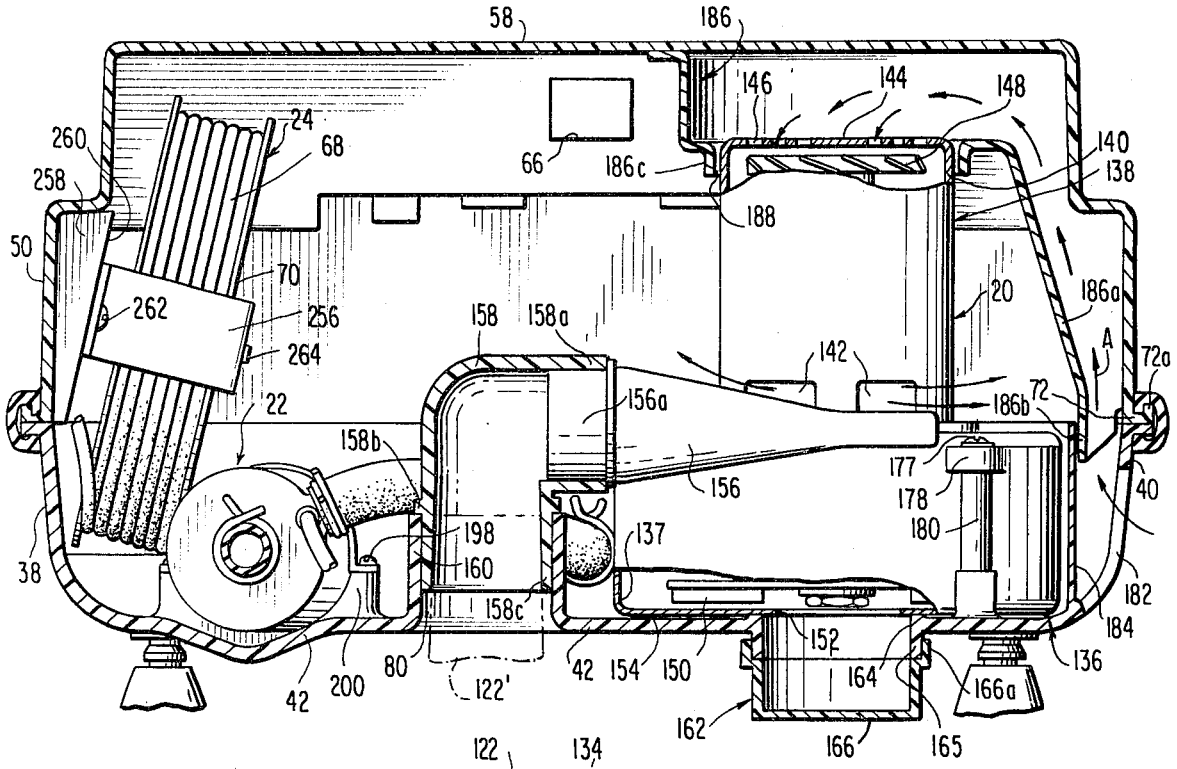
FIG. 5 is a vertical sectional view of the machine of FIG. 4, taken about line 5—5.

As may be further seen by viewing FIGS. 4 and 5, the positive pressure air which is on the exhaust side of the vacuum pump 20 exits through the exhaust port 80 via tapered exhaust pipe 156 and elbow 158. The downstream end of exhaust pipe 156 terminates in a circular male connector 156*a* which is received within one end 158*a* of the exhaust pipe elbow 158. In turn, the elbow 158 includes an outer collar 158*b* at its male coupling end 158*c* which collar acts as a stop when the end 158*c* is closely inserted within the integral tubular portion 160 of the bottom wall 142 of the lower casing section 14. By placement of the male coupling 156*a* of the exhaust pipe 156 within one end of the exhaust pipe elbow 158 and the opposite end 158*c* of that same elbow within tubular projections 160 of the bottom wall, the vacuum pump is properly connected at the exhaust port 80, permitting the screws 176 to lock the vacuum pump to the casing lower casing section 14 with these components in place and held thereby.

An important aspect of the present invention is the placement and operation of the water pump 22 and in particular the means for insuring recirculation of the water between the water pump 22 and the water storage or supply tank 26. Water pump 22 is an electrical motor driven assembly which is of the electrically double insulated type. The water pump 22 is comprised, FIG. 4, of a pump motor section 192 to the right and a pump impeller section 194 to the left. The pump is maintained in position by a sheet metal band 196 which is screwed to the bottom of the casing 12, on opposite sides, by screws 198. The band 196 is generally U-shaped in configuration, with its ends flanged as at 196*a*, FIG. 5, and the cylindrical pump is held in position within a saddle 200 integral with casing bottom wall 42 including posts on opposite sides thereof, within which the screws 198 project.

In the illustrated embodiment, there is provided an water pump axial inlet hose as at 202 and a radial pump outlet or discharge hose 204. The inlet hose connects, at one end, to the end of the pump impeller section 194 while the outlet hose connects radially to the same impeller section 194. Suitable hose clamps 206 maintain the inlet and outlet hoses coupled to the pump 22 and to other fittings. Further, a pump inlet nipple 208 is borne by the water storage or supply tank 26 and projects through the outer wall 82 of that tank. A further hose clamp 206 connects the other end of the inlet hose to nipple 208.

One aspect of the present invention has to do with the recirculation of a small volume of water which is returned back to the water storage or supply tank 26 by way of a clear plastic recirculation or bypass hose 210, one end of which is connected via a nipple 212 to the discharge side of the impeller section 194 of pump 22, the opposite end of the hose being connected to a fitting or nipple 214. Nipple 214 penetrates water supply tank outer wall 82 and terminates in a nozzle 214*a* opening to the interior 88 of the water storage or supply tank 26. Thus when no water is being directed onto the surface being cleaned through the pump outlet hose 204, water is continuously recirculated through the inlet hose 202, the impeller section 194 of the pump and the recirculating hose 210, back to the interior of the tank 26. Water jetted into the water tank interior creates some circulation, tends to maintain the chemicals in suspension within the water to maintain proper chemical content for the water being released in jet form at the nozzle borne by the vacuum head (not shown), and prevents vapor lock in the pump.

In that respect, a hot water hose coupling is provided at 216, mounted to front end wall 40 of the lower casing section 14. The hot water hose coupling is of the snap fit type and permits a female coupling member of the hot water delivery hose (not shown) itself to be demountably attached by way of coupling 216 to the discharge end of the pump outlet hose 204. The outlet hose 204 is coupled to the coupling 216 by fitting one end of the hose over a tubular terminal end 216*a*. A hose clamp 206 formed of a resilient wire loop functions to sealably couple the end of hose 204 to that member. Such arrangements and the coupling 216 itself are standard in the art.

As may be appreciated, when the water valve (not shown) controlling water flow from the supply tank to a jet spray nozzle mounted to the vacuum pick-up head (neither shown) is shut off, a high pressure bypass for the water is provided on the outlet side of the impeller section 194 leading back to the tank via recirculation hose 210 to shoot a stream of water into the interior 88 of the water tank to keep the water circulating. The continuous circulation principally prevents any vapor lock in the water pump.

As mentioned previously, the double insulation vacuum pump 22 is manufactured by Sierra Electric Motors, a division of Parise and Sons, Inc., the corporate assignee of the present application. The pump 22 includes an electrically insulated shaft leading from motor section 192 to the impeller section 194 such that an eletrical short within the motor section is not transmitted to the water circulating to and from the water storage tank 26 or directed by way of the pump outlet hose 204 to the spray nozzle associated with the vacuum head to cause electrical shock to the operator of machine 10.

As mentioned previously, the electrically double insulated vacuum extraction machine may operate in either a dry vacuum extraction mode or a wet vacuum extraction mode. Reference to FIG. 6 illustrates the machine under conditions in which it is acting as a hot water vacuum extraction machine.

In that respect, mounted to the upper end of the riser tube 106 is the splash deflector and filter assembly 30. This assembly comprises an inverted dish-shaped water deflector plate 218 which may be formed of translucent or clear plastic, as preferably is dome 18, so the interior or the dump tank 28 may be viewed during machine operation. The inverted dish-shaped plate 218, which is concave downwardly, is fixedly coupled by way of a plurality of vertical struts 220 to an annular baffle ring 222 having an internal diameter on the order of the external diameter of riser tube 106 so that it forms a close frictional fit with that member, when slid thereon. Further, each of the struts is provided with a notch as at 220*a* which acts as a physical stop to limit the downward movement of the assembly 30 on the upper end of the riser tube 106. The upper end of tube 106 abuts the end of the notch 220*a* on each strut 220. About the struts 220, is wrapped a plastic or other material screen 224 forming a primary filter for the dump tank. Filter cup 172 functions as a secondary filter for air returning from the vacuum pick-up head (not shown). Posts 220 may be integrally molded or otherwise fixed to the deflector plate 218, along with the ring 222. Ring 222 functions as a baffle to prevent foam or the like from rising upwardly about the outside of the riser tube 106 during wet vacuum extraction operation due to the tendency for creation of a low vacuum pressure are about the periphery of the riser tube 106 by application of vacuum pressure to the interior of the riser tube 106 through the channel track 162.

The return water with the entrained dirt enters the interior of the dump tank through the elbow 122, splashes against the upper surface of the deflector plate 218, falls downwardly and accumulates within the bottom of the dump tank 28. When the water rises to a level approaching the upper end of the riser tube 106, the machine operation must be stopped. Whereupon, the dome 18 is rotated from the position shown in FIG. 8 to the position shown in FIG. 9, permitting lifting and removal of the dome 18 and subsequently removal of the dump tank 28 from cylindrical wall 86 to allow dumping of the dirty water within the same. If needed, the deflector assembly 30 may be removed from the riser tube 106 and the screen 224 functioning as the primary filter may be cleaned. This also permits the filter cup 172 to be removed and cleaned if necessary.

Figure 7:
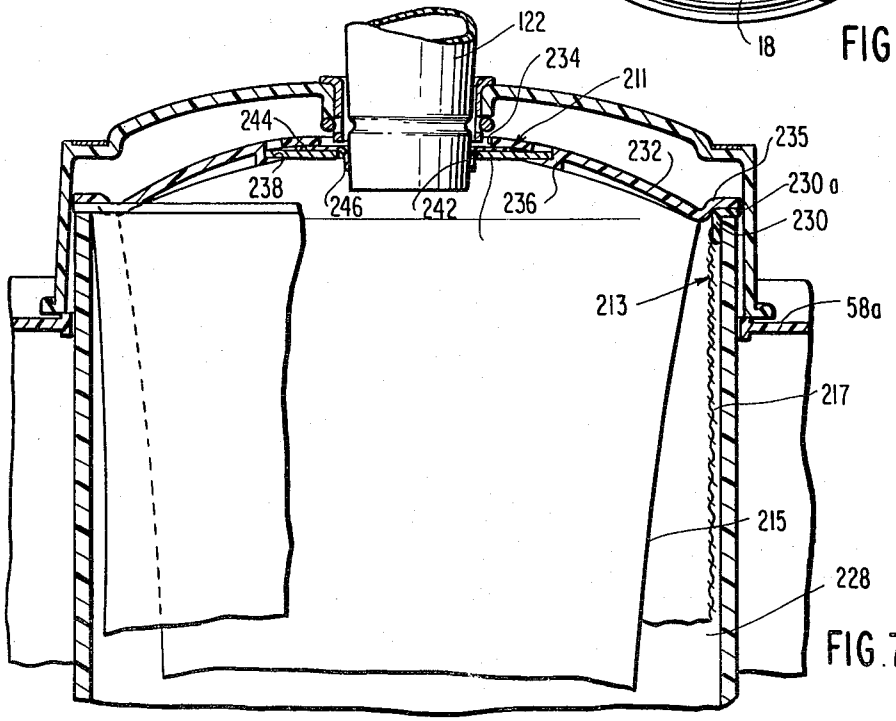
FIG. 7 is a vertical sectional view through a portion of the machine similar to that of FIG. 6, under dry vacuum cleaning mode.

The present machine is instantly adaptable for use as a dry vacuum cleaner in a manner evidenced in FIG. 7. In this mode of operation, the dump tank 28 is removed from the cylindrical inner wall 86 of the water storage or supply tank 28, after removal of dome 18. Further, the splash deflector and filter assembly 30 is carried along with the dump tank. It may be maintained on the riser tube 106. As may be appreciated, the filter cup 172 is retained within opening 168 at the bottom of the lower casing section 14 and vacuum application is applied, not to the interior of a dump tank as at 28, but rather to a large cylindrical cavity 228 formed by the inner wall 86 of the water storage tank 26, bottom wall 42 of the casing lower section 14 and dome 18. In order to perform a dry vacuum cleaning operation, there is the necessity to capture the dirt entrained in the air stream emanating from the head and passing through the wand (both of which are not shown) and leading to the elbow 122 which again projects through the dome spherical wall 116 and within the opening formed by mounting ring or collar 128.

The dry vacuum cleaner mode depends upon two principal components: (1) a cloth backup filter assembly indicated generally at 211; and (2) a porous paper bag primary filter assembly indicated generally at 213. While a paper bag as a filter member and as a container for captured dirt has long been employed in dry vacuum machines, in the instant situation, backup filter assembly 211 functions as a backup filter system for a paper bag 215. Bag 215 is located internally of a cloth bag 217, as parts of respective assemblies 211 and 213. As may be appreciated, vacuum pressure must be maintained within a chamber 228 defined by cylindrical inner sidewall 86 of the water storage tank 26. Initially, after the dome 18 is removed by rotation of the dome 18 from a position shown in FIG. 8 to that shown in FIG. 9 and lifted vertically above the casing 12, the cloth backup filter assembly 213 is mounted to the upper edge of the cylindrical wall 86 as shown in FIG. 9. The cloth backup filter assembly 213 is supported by an inverted L-shaped cross-section, rubber mounting ring 230 including a horizontal portion 230*a* which rests on the upper edge of wall 86 and an integral vertical portion 230*b* which fits to the inside of the cylindrical wall 86 and to which is attached by sewing, riveting or the like, the open end of cloth filter bag 217, the bag being generally cup-shaped in form.

Overlying the rubber mounting ring 230, is the periphery of a curved paper filter bag support plate indicated generally at 232, the plate 232 having a diameter on the order of the cylindrical wall 86 defining cavity or chamber 228. It is concave downwardly and includes a circular opening or hole 234 at the center thereof. Further, its outer periphery comprises a circular rim or lip 235 which rests on the top of the rubber mounting ring 230 for the cloth filter bag 217. On diametrically opposite sides of the circular opening 34, there are integrally formed, spaced parallel L-shaped tracks 236 which depend from the bottom of the plate 232, the tracks 236 forming elongated slots as at 238 within which is frictionally slid opposite edges of a rectangular cardboard paper bag mounting sheet 240. The sheet 240 is provided with a circular opening or hole 242 within its center. On the upper surface of the paper bag mounting sheet 240, there is provided a rectangular rubber seal sheet 244 which bears a circular opening 246 within the center. Opening 246 is smaller than opening 242 within the cardboard mounting sheet 240 for the paper bag 224. Further, the diameter of the opening 246 within the rubber seal sheet 244 is smaller than the diameter of the elbow 122 whose lower end projects through the rubber sheet 244 when the elbow is snap coupled to the dome 18 and the dome is locked in place on the casing 12 in the manner of FIG. 8. The paper filter bag 215 is generally rectangular in transverse configuration and has its upper ends sealed to the paper bag cardboard support sheet 240 such that the dirt is entrained within the bag when vacuum pressure is applied to chamber 228 with the vacuum pressure acting initially through the cloth filter bag 217 and thence through the paper filter bag 215. Additionally, the paper filter bag 215 has its sides tapering downwardly and inwardly towards each other so that vacuum pressure is applied to the interior of the paper bag 215 above the accumulated dirt and debris as the debris starts to fill the bag 215. Were the bag not tapered, there would be a possibility of closing off the interior of chamber or cavity 228 by a partially filled bag which would prohibit continued vacuum pressure application to the interior of the bag above the accumulated debris and, of course, loss of suction to the vacuum pick-up head (not shown) leading to the paper bag 215 through the elbow 122.

The application of vacuum pressure maintains the paper filter bag support plate 232 against the rubber mounting ring 234 holding the cloth filter bag 217. Further, mechanically, dome 18 is locked to the upper casing section 16 and a seal is maintained by way of ring seal 92 between the lower casing section bottom wall 42 and the bottom wall 84 of the double walled water storage tank 26.

The operation is somewhat the same under dry vacuum cleaning mode. With the paper filter bag 215 internally of the cloth filter bag 217, and the paper bag support plate 232 overlying the open end of the cavity 228 defined by water supply tank cylindrical wall 86 and with dome 18 in locked position, the operation of vacuum pump 20 creates an effective vacuum pressure within the vacuum pick-up head (not shown) leading to elbow 122, such that any dirt entrained in the air stream under vacuum pressure leading to the paper bag 224 is delivered to the paper bag where it is filtered thereby. Air cleaned of debris returns to the vacuum pump. The cloth filter bag 217 acts as a back up for holding any escaped debris or dirt, particularly if there should be a hole within the paper filter bag 215 or for some reason the bag should disintegrate during use. Additionally, the filter cup 172 will capture any debris tending to be sucked into manifold passage 176 of the channel track 162 and leading to the inlet port 152 of the vacuum pump 20. When the bag 215 is nearly full of dirt, debris, etc., the machine must be shut off, the dome 18 rotated to the position shown in FIG. 9 from FIG. 8, lifted and the paper filter bag support plate 232 removed from the top of the cylindrical inner wall 86 of the machine. The filter bag is slid from its support plate 232 by pulling the cardboard sheet 240 outwardly of slots 238 formed by the parallel tracks 236. The paper filter bag 215 and contents are then thrown away and a new filter bag mounted to support plate 232 if the machine is to be again operated under a dry vacuum extraction mode. Alternatively, the dump bucket 28 with its splash deflector and filter assembly 30 may replace the paper filter bag assembly 211 and the cloth filter bag assembly 218.

As evidenced in FIG. 1, the machine is equipped with a vacuum indicator light or lamp 248 which indicates an increase in vacuum pressure resulting from the paper filter bag 224 being full or nearly full, the light 248 being normally off but energizable in response to operation of a vacuum pressure sensor (not shown) opening to chamber 228. The vacuum pump 20 is operated in response to its energization through a manual toggle switch operator 250, to the left of the indicator light 248, FIG. 1. There is an additional indicator light at 252 which is lit at any time that the water pump 22 is operating and water is depleted from water supply tank 26, the pump operation being effected by a second toggle switch operator 254 to the right of the indicator light or lamp 252. Both toggle switches are manually operated.

As mentioned previously, internally of the casing 12, FIG. 5, there is mounted an electric cord reel assembly 24 comprised of a generally U-shaped reel support plate 256 mounted to an inclined bracket 258 integrally molded or otherwise formed and adhesively fixed to the inside of sidewall 46 of the upper casing section 16. Bracket 258 has purposely, an inclined or tapered face 260 such that the U-shaped mounting plate 256 is inclined from the horizontal. Screws as at 262 mount the U-shaped support plate 256 to bracket 258. The reel is mounted for rotation about an axel 264. Reel 70 rotates about an axis inclined slightly from the horizontal to insure that cord 68 self feeds during wind up to insure even feeding of the cord along the reel drum. A conventional male plug (not shown) is connected to the end of the cord 68, with the plug projecting exteriorly of the casing 12 through an opening (not shown). The cord normally retracts to the extent where the plug contacts the face of casing 12. The cord can be pulled outwardly for plugging into a wall socket or the like to energize the electrical components of the machine. Further, window 66 functions to hold a female connector or plug which allows a suitable electrical cord to be connected thereto leading to a power head (electric motor operated brush) within a modified vacuum pick-up head at the lower of a wand (not shown). It should be appreciated that the ring seals discussed previously as at 92, 110, 112 and the rubber mounting ring 230 for the cloth filter bag 226 are formed of closed cell rubber. They are not porous, and in fact function to provide the desired seal for the vacuum pressure internally of the dump tank 28 when it is utilized under a wet vacuum extraction mode or within chamber 228 when the machine is operating as a dry vacuum cleaner.

The toggle switches operators 250 and 254 bear rubber covers to electrically insulate these members and to insure the electrical double insulation protection desired.

Figure 11:
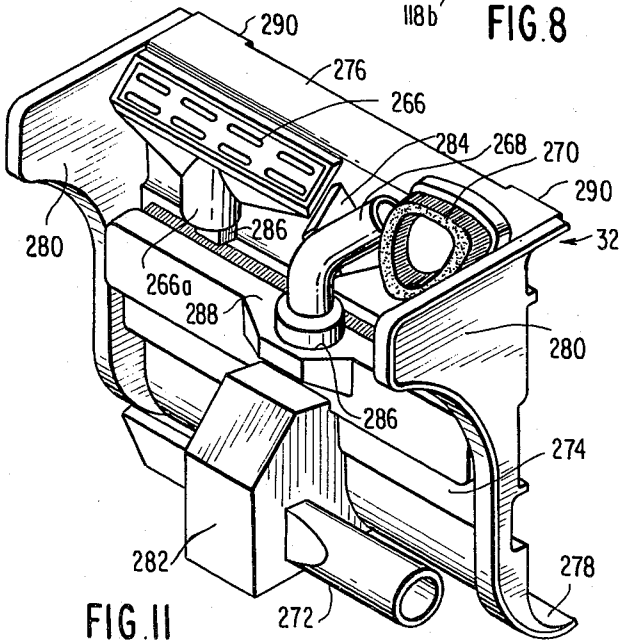
FIG. 11 is a perspective view of the tool caddy which may be snap coupled to one end of the machine casing, as illustrated in FIG. 2, to permit the caddy to function as a stand, as per FIG. 3.

Referring to FIGS. 2, 3 and 11, a further aspect of the present invention is directed to the removable tool caddy 32 which provides a dual function. As may be appreciated in FIG. 11, the tool caddy, which demountably attaches to the rear of the machine, functions to removably support various tools as at 266, 268, 270, and 272. These tools are components mountable to the end of the wand and permit vacuum force application to various surfaces being cleaned. The tools are conventional and the novelty resides in the make up of the caddy itself, the utilization of slots or the like within the various portions of the caddy to permit mounting of the detachable or removable mounting of the tools 266, 268, 270 and 272, and its function as a stand.

As may be appreciated, the caddy is formed of molded plastic as by ejection molding or the like, and is unitary in nature. It is formed principally of a generally rectangular base plate 274 bearing, integrally, a right angle flange 276 at its upper end, and a curved flange 278 at its lower end. Further, a pair of wings or sides 280 are integrally provided at the rear of the base 274 and directed oppositely to flanges 276 and 278. The wings 280, to each side, function in combination with an integral central projection 282, also directed rearwardly of base 274 and intermediate of the wings 280, to form a three point support for the machine 10 when upturned from the position shown in FIG. 2. Thus, caddy 32 functions as a stand for an upturned machine as indicated in FIG. 3.

The base 274 is provided with a number of integral projections as at 286 whose free ends project upwardly from the rear surface of base 274, parallel to base 274, which ends receive the tubular portions of various tools, as at 266*a* for tool 266 and a tubular portion (not shown) of tool 270. Further, the base 274 supports a saddle member 284 bearing a circular groove on the end remote from the base within which rides a portion of a tubular elbow of tool 268, the opposite end of the tool elbow being received within a circular hole as at 286 within an integral projecting shelf 288 formed within base 274, at its rear, and above projection 282.

The caddy is detachably mounted by means of a pair of hooks as at 290 to opposite ends of flange 276, the hooks riding over the narrow ledge 97 at the rear of the machine and formed within the upper casing section 16. Further, the two hooks 290 operate in conjunction with a finger latch 292. Latch 292 takes the form of a projecting finger which is directed forwardly from the curved bottom flange 278 at the center thereof. The end of latch 292 clips to a shoulder or notch 294 formed within the bottom wall 42 of the lower casing section 14, at the rear of the machine. As may be appreciated, there is a certain amount of resilience provided by the flanges 276 and 278 and in particular by the finger latch 292 which permits the snap coupling of the caddy to casing 12 of the machine. This resilience is sufficient to insure that there is no decoupling when the machine is stood on end as seen in FIG. 3 with the caddy resting on the floor or support surface F by way of the two wings 280 and the central projection 282 of that member. As may be further appreciated by reference to FIG. 3, rectangular openings 282*a* are provided within opposed lateral walls of projection 282 through which pass portions of tool 272. The tool 272 is lodged within the rectangular openings 282*a* under a wedge fit. All tools may be removed from the caddy 32 when the caddy is employed as a stand or alternatively the tools may remain attached in the manner shown in FIG. 11.

As further may be appreciated in FIG. 2, the front face 274*a* of base 274 is purposely econfigured so as to cooperate with the casing 12 and with the rubber bumper 74. In that respect, a rectangular slot 274*b* is provided within the casing base 274 configured to receive rubber bumper 74.

As may be appreciated, the assembly of the upper casing section 16 to the lower casing section 14 is accomplished by means of two screws, one of which is seen in FIG. 2 at 294 and projecting upwardly through flange 296 of casing wall 34 and being screwed to a mounting block 298 fixed to the inner surface of end wall 46 of the upper casing section 16. A similar arrangement is provided at the front of the machine. The two screws act in conjunction with the rubber bumper 74 to maintain the upper and lower sections 16 and 14 joined. As may be appreciated, by removal of the two screws and by pulling the resilient bumper 74 off casing 12, the casing sections 14, 16 may then be separated to facilitate servicing of the components, interiorly.

Additionally, by reference to FIG. 5, it may be seen that elbow 122 or a special discharge elbow 122, FIG. 5, may be connected to the machine at port 80 such that positive air pressure flows through that elbow and a connected hose (not shown). This would provide a positive pressure air stream for paint spraying or the like. The elbow 122' is simply inserted from beneath the machine as shown in phantom line to supply the vacuum pump discharge air which is a positive air flow stream to an end use tool such as a paint sprayer or the like (not shown). The frictional grip provided by a tapered fit between parts is all that is required to maintain the end of elbow 122' within the vertical portion 158*c* of elbow 158, leading to the discharge side of the vacuum pump.

While the invention has been described in detail and with reference to specific embodiments thereof, it will be apparent to one skilled in the art that various changes and modifications can be made therein without departing from the spirit and scope thereof.

What is claimed is:

1. An electrically double insulated wet/dry vacuum extraction machine comprising:

an outer casing of electrical and thermal insulation material, said casing being generally rectangular in plan configuration and formed of longitudinally spaced vertical end walls, laterally spaced vertical sidewalls, a bottom wall and a top wall, an annular opening within said top wall, a double walled water tank formed of electrical and thermal insulation material mounted within said casing, said water tank comprising integrally inner and outer vertical walls and a bottom wall, said inner wall being of tubular form and centered within the opening wihtin the top wall of said outer casing, a removable tubular dump tank mounted coaxially within said tubular inner wall of said water tank, a dome overlying the opening within said outer casing top wall, means for locking said dome to said casing, in sealed contact with the top of the dump tank, means for mounting at least one filter bag assembly within the interior of said water tank inner wall upon removal of said dump tank such that application of vacuum pressure to said dump tank or to the interior of said at least one filter bag assembly permits machine operation selectively under wet and dry vacuum extraction modes, means for supplying vacuum pressure to the interior of said dump tank during said wet vacuum extraction mode, and to the interior of said inner wall of said water tank during said dry vacuum extraction mode, and elbow means carried by said dome and projecting therethrough for returning air, water and entrained dirt during wet vacuum extraction mode to the dump tank and air plus entrained dirt to said at least one filter bag assembly when operating under dry vacuum extraction mode.

2. The machine as claimed in claim 1, wherein said dump tank is an upwardly open cylindrical container including a flanged rim at the open end thereof, said container further comprising a riser tube mounted to said tank and extending upwardly from the bottom thereof, being open at its lower end through the bottom of said tank and being open at its upper end and rising short of the top of said dump tank, and wherein vacuum pressure is applied through an opening within the bottom wall of said casing aligned with said riser tube, a first seal ring is interposed between the bottom of said dump tank and the bottom wall of said casing surrounding said vacuum pressure application opening, and wherein said dome bears a second ring seal mounted to the bottom thereof and contacting the open end of said dump tank such that under vacuum pressure said dump tank is maintained sealed against the bottom wall of said casing and said dome is maintained sealed against the upper end of said dump tank cylindrical sidewall.

3. The machine as claimed in claim 2, further comprising a splash deflector and filter assembly carried by said riser tube within said dump tank, said splash deflector and filter assembly comprising an upwardly convex plate overlying the upper end of said riser tube, a plurality of struts depending downwardly from said deflector plate and circumferentially spaced about said riser tube, a baffle ring fixed to the lower end of said struts and having an inside diameter on the order of the outside diameter of the riser tube and slidably engaging said tube, and a filter screen surrounding said struts and interposed between said baffle ring and said deflector plate, and said struts including means for maintaining said deflector plate spaced axially at its center from the upper end of said riser tube; and wherein, said elbow projects through said dome coaxially with said deflector plate and said riser tube; whereby, return liquid and entrained dirt axially enter the interior of said dump tank with the liquid being deflected by said deflector plate towards the cylindrical sidewall of said dump tank to prevent liquid intake into the riser tube, said baffle ring preventing foam from moving upwardly on the outside of said riser tube and into the interior of said riser tube upon vacuum pressure application and said screen filters debris and dirt from the return air escaping outwardly of said dump tank through said riser tube under vacuum application.

4. The machine as claimed in claim 1, wherein said dome locking means includes a recess within the casing top wall surrounding said top wall circular opening, said recess forming laterally opposed short vertical wall portions spaced from said circular opening at diametrically opposite positions, opposed elongated slots within said short vertical wall portions of said casing formed by said recess portion of said top wall and wherein said dome comprises an inverted cup-shaped member including a cylindrical sidewall, opening downwardly, the lower end of said sidewall bearing an outwardly directed radial flange, said dome locking means further includes flats formed within said radial flange at diametrically opposite positions, said radial flange being sized and the distance between said short vertical wall portions bearing said elongated slots being such that said dome may be positioned on said casing with the flats aligned with the elongated slots within the short vertical wall portions and thence rotating to cause the flanges to enter the slots to frictionally lock the dome to the casing and compressing said first and second ring seals.

5. The machine as claimed in claim 1, wherein said outer sidewall of said water storage tank extends upwardly and terminates in a flanged upper end, said casing bears a sealing strip on the inner surface thereof underlying said top wall in contact with the flanged upper end of said water storage tank outer sidewall, and wherein a third ring seal is mounted to the upper surface of the casing bottom wall, outwardly of said first ring seal, and is interposed between said casing bottom wall and the bottom wall of said water storage tank such that, inn the absence of said dump tank, a vacuum seal may be effected between said water supply tank and said casing to permit dry vacuum extraction operation of the machine.

6. The machine as claimed in claim 5, further comprising a removable plug within said casing top wall providing access to the interior of said water supply tank for supplying hot water to the supply tank.

7. The machine as claimed in claim 5, wherein a water pump is mounted within said casing, said water pump including a motor section and an impeller section, a water pump inlet hose mounted at one end to said water pump impeller section and mounted at its other end to a supply nozzle projecting through the outer sidewall of said water supply tank, said supply nozzle opening to the interior of said water supply tank, a water outlet hose mounted at one end to said pump impeller section and mounted at its opposite end to a water hose coupling projecting through said casing end wall, the improvement wherein said water pump includes a recirculation hose coupled at one end to the discharge side of said impeller section, and coupled at the other end to a fitting projecting through the outer sidewall of said water supply tank, said fitting including a jet nozzle at its end within said water supply tank; whereby, during operation of said water pump, a limited volume of water is recirculated between the pump and the water supply tank for preventing vapor lock within the water supply pump.

8. The machine as claimed in claim 1, wherein said at least one filter bag assembly comprises a downwardly concave filter bag support plate having a diameter on the order of the inner sidewall of said water supply tank and spanning across the top of said tank with its periphery overlying the upper end of said tank inner sidewall said filter bag assembly mounting means comprises an opening in said filter bag support plate at its center and a tubular end of said elbow means coupled to the dome and projecting through said opening laterally spaced parallel tracks carried by the bottom of the said filter bag support plate and forming slots between the tracks and the plate, a filter bag mounting sheet slidably and frictionally engaging said slots and including an opening within the center thereof further receiving the projecting end of said elbow, a rubber seal sheet fixedly mounted to the face of the bag support sheet and having an opening within the center thereof of a diameter less than that of said projecting elbow and in sealing engagement with the outer periphery thereof, and a primary filter bag mounted to said filter bag mounting sheet and depending therefrom and positioned within the interior of said tubular inner sidewall of said water supply tank, and seal means interposed between the periphery of the rim of said filter bag support plate and the end of said water tank cylindrical inner sidewall such that the application of vacuum pressure to the interior of the inner tubular sidewall of said water supply tank permits debris returning with the air and flowing through the elbow, to be separated from said air and retained by the primary filter bag.

9. The machine as claimed in claim 8, wherein said primary filter bag is a paper bag and said seal means interposed between the rim of said filter support plate and the water supply tank inner sidewall comprises a rubber ring seal, and wherein a back up cloth filter bag is mounted to said ring, and is interposed about said primary filter bag and functions as a secondary filter and as a back up in case the paper filter bag is defective or ruptures during machine operation.

10. The machine as claimed in claim 4, wherein said dome locking means further comprises axial projections along the upper surface of said radial flange of said dome at circumferentially spaced positions intermediate of said flats; whereby, said axial projections engage the outer surfaces of said short vertical wall portions after said flanges project through the slots to frictionally lock the dome to the casing.

11. The machine as claimed in claim 1, wherein said outer casing comprises upper and lower casing sections formed of molded plastic and of generally rectangular in plan configuration, said sections terminate in outwardly directed flanges which abut, at least one of said flanges being generally L-shaped in configuration, and wherein an elastic rubber bumper of C-shaped cross-section frictionally engages said flanges to clamp and seal the abutting flanges of said upper and lower casing sections together while permitting ready disassembly of said casing sections, and wherein said bumper functions to absorb impact of the machine with objects to eliminate damage to furniture and the like during use.

12. The machine as claimed in claim 11, wherein said means for applying vacuum pressure to said opening within the bottom of said casing underlying said dump tank and centered with respect to said double walled water tank comprises a vacuum pump mounted to the side of said water tank and within said casing, said vacuum pump comprising an overlying vertically oriented electrical motor, an underlying blower impeller section, said blower impeller section including a cylindrical housing open centrally at its bottom and aligned with a second opening within the bottom of said casing and forming a suction inlet opening for said vacuum pump blower impeller section, and wherein means forming an elongated sealed channel extends across the bottom of said casing bottom wall and sealably connects the casing opening aligned with the riser pipe with the casing opening leading to the blower impeller section suction inlet opening.

13. The machine as claimed in claim 12, wherein said vacuum pump motor comprises a cylindrical casing including a cylindrical sidewall and a horizontal end wall at the upper end thereof, air inlet openings within said motor casing end wall, a plurality of circumferential slots within said motor casing cylindrical sidewall at the lower end thereof, and wherein said lower casing section includings a plurality of motor cooling air inlets slots within one of said sidewalls, a vertical barrier wall of C-shaped vertical cross-section integral with said lower casing section and rising the height of said lower casing section adjacent said air inlet slots and parallel with said sidewall and functioning as a barrier for the insertion of a metallic element likely to compromise the electrical double insulation of the machine, and shroud means carried by said upper casing section and defining with said barrier wall a confined air flow path for said cooling air emanating from said air inlet slots within said casing lower section sidewall, said shroud means leading to the cooling air inlet openings within said motor casing end wall and preventing moisture from entering the motor for said vacuum pump.

14. The machine as claimed in claim 13, wherein said shroud means includes a lip which depends below said casing upper section and which fits within a cavity defined by said barrier wall and said lower casing sidewall, and wherein said shroud means further includes a cylindrical opening receiving the upper end of said cylindrical casing sidewall of said vacuum pump motor to restrict air flow and prevent moisture entry into the interior of the vacuum pump motor.

15. The machine as claimed in claim 14, further comprising a cylindrical projection integral with the casing bottom wall defining an exhaust port laterally to one side of said vacuum pump motor, and wherein said vacuum pump motor includes an exhaust pipe extending from the blower impeller section, an elbow mounted to said exhaust pipe at one end and fitted to the casing bottom wall cylindrical projection such that air under positive air pressure exhausting from said vacuum pump, flows outwardly through said discharge port beneath the machine.

16. A wet/dry vacuum extraction machine comprising:

a casing, said casing being generally rectangular in plan configuration and formed of longitudinally spaced vertical end walls, laterally spaced vertical sidewalls, a bottom wall and a top wall, a circular opening within said top wall, a double walled water tank mounted within said casing, said water tank comprising integrally inner and outer vertical walls and a bottom wall, said inner wall being of tubular form and centered within the opening within the top wall of said outer casing, a removable tubular dump tank mounted coaxially within said tubular inner wall of said water tank, a dome overlying the opening within said outer casing top wall, means for locking said dome to said casing in sealed contact with the top of said dump tank, means for mounting at least one filter bag assembly within the interior of said water tank inner wall upon removal of said dump tank such that application of vacuum pressure to said dump tank or to the interior of said at least one filter bag assembly permits machine operation selectively under wet and dry vacuum extraction modes, means for supplying vacuum pressure to the interior of said dump tank during said wet vacuum extraction mode, and to the interior of said inner wall of said water tank during said dry vacuum extraction mode, and elbow means carried by said dome and sealably projecting therethrough for returning air, water and entrained dirt during said wet vacuum extraction mode operation to the dump tank and air plus entrained dirt to said at least one filter bag assembly during said dry vacuum extraction mode operation.

* * * * *